United States Patent [19]

DuBois

[11] Patent Number: 4,551,076

[45] Date of Patent: Nov. 5, 1985

[54] FLUID DRIVEN PUMP WITH ONE-WAY VALVE IN FLUID INLET

[75] Inventor: Chester G. DuBois, Zion, Ill.

[73] Assignee: Outboard Marine Corporation, Waukegan, Ill.

[21] Appl. No.: 540,045

[22] Filed: Oct. 7, 1983

[51] Int. Cl.[4] ..... F02B 33/06

[52] U.S. Cl. ..... 417/395; 123/73 AD; 123/DIG. 5; 91/446

[58] Field of Search ..... 417/380, 395, 401, 402, 417/392; 123/73 AD, 196 CP, 198 C, DIG. 5; 91/446, 448, 346

[56] References Cited

U.S. PATENT DOCUMENTS

| | | | |
|---|---|---|---|
| 2,298,106 | 10/1942 | Carlson | 91/346 X |
| 2,804,055 | 8/1957 | Hill et al. | 91/346 X |
| 2,951,745 | 3/1958 | Sweet et al. | 23/253 |
| 3,386,388 | 6/1968 | Rosenberg | 417/395 |
| 3,653,784 | 4/1972 | Leiterman et al. | 91/346 X |
| 3,765,802 | 10/1973 | Letterman et al. | 417/395 |

FOREIGN PATENT DOCUMENTS

| | | | |
|---|---|---|---|
| 2108212 | 5/1983 | United Kingdom | 60/397 |

*Primary Examiner*—Leonard E. Smith

*Attorney, Agent, or Firm*—Michael, Best & Friedrich

[57] ABSTRACT

A fluid driven pump comprising a pump housing defining a recess including therein a moveable wall which divides said recess into a variable volume driving chamber and a variable volume pumping chamber. The pump also includes a pressure inlet communicable with the driving chamber and adapted to communicate with a source of pressure which oscillates between an operating pressure and a pressure different from the operating pressure. The pressure inlet includes a one-way valve for permitting fluid under the operating pressure to communicate with the driving chamber to move the moveable wall in one direction when the driving chamber is in communication with the pressure inlet. The pump also includes a vent communicable with the driving chamber and adapted to communicate with a source of pressure different from said operating pressure, a spring for moving the moveable wall in the opposite direction when the driving chamber is in communication with the vent, and a shuttle valvearrangement for selectively controlling communication of the driving chamber with the pressure inlet and the vent. In another embodiment, the vent is adapted to be in communication with the oscillating pressure source and the spring is replaced with a one-way valve in the vent for permitting fluid under the pressure different from the operating pressure to communicate with the driving chamber.

21 Claims, 4 Drawing Figures

FLUID DRIVEN PUMP WITH ONE-WAY VALVE IN FLUID INLET

BACKGROUND OF THE INVENTION

This invention relates to fluid driven pumps and, more particularly, to fluid driven pumps adapted to be driven by a source of fluid pressure which oscillates between a maximum pressure and a minimum pressure.

Existing pumps driven by an oscillating fluid pressure source, such as the crankcase of a two-stroke engine, have limited capacity for pumping fluid.

This results from the pump having a slower discharge rate than the frequency at which pressure oscillations occur in the crankcase. Because the pressure oscilations occur faster than the discharge rate of the pump, the pressure pulse from the pressure source begins to diminish before the pump completes the discharge of fluid. As a result, the amount of fluid which can be delivered by the pump is less than if fluid could be fully discharged by the maximum pressure pulse achieved in the crankcase.

Attention is directed to the pumps disclosed in Leitermann, et al. U.S. Pat. No. 3,765,802, issued Oct. 16, 1973 and Sweet et al. U.S. Pat. No. 2,951,745, issued Sept. 6, 1960.

SUMMARY OF THE INVENTION

This invention provides a fluid driven pump comprising a pump housing defining a recess including therein a moveable wall which divides the recess into a variable volume driving chamber, and a variable volume pumping chamber. The pump also includes a pressure inlet communicable with the driving chamber and adapted to communicate with a source of pressure which oscillates between an operating pressure and a pressure different from the operating pressure. The pressure inlet includes one-way valve means for permitting fluid under the operating pressure to communicate with the driving chamber to move the moveable wall in one direction when the driving chamber is in communication with the pressure inlet. The pump also includes a vent communicable with the driving chamber and adapted to communicate with a source of pressure different from the operating pressure, means for moving the moveable wall in the opposite direction when the driving chamber is in communication with the vent, and means for selectively controlling communication of the driving chamber with the pressure inlet and the vent.

The invention also provides a fluid driven pump comprising a pump housing defining a recess including therein a moveable wall which divides the recess into a variable volume driving chamber and a variable volume pumping chamber, a pressure inlet communicable with the driving chamber and adapted to communicate with a source of pressure which oscillates between a positive operating pressure and a pressure less than the operating pressure, the pressure inlet including a one-way valve permitting fluid flow into the driving chamber and prohibiting fluid flow from said driving chamber, and thereby to move the moveable wall in one direction when the driving chamber is in communication with the pressure inlet, a vent communicable with the driving chamber and adapted to be in communication with a source of pressure different from the operating pressure, means for moving the moveable wall in the opposite direction when the driving chamber is in communication with the vent, and means for selectively controlling communication of the driving chamber with the pressure inlet and the vent.

The invention also provides a fluid driven pump comprising a pump housing defining a recess including therein a moveable wall which divides the recess into a variable volume driving chamber and a variable volume pumping chamber, a pressure inlet communicable with the driving chamber and adapted to communicate with a source of pressure which oscillates between an operating pressure and a pressure different from the operating pressure, the pressure inlet including one-way valve means for permitting fluid under the operating pressure to communicate with the driving chamber and thereby to move the moveable wall in one direction when the driving chamber is in communication with the pressure inlet, a vent communicable with the driving chamber and adapted to be in communication with a source of pressure different from the operating pressure, a spring in the pumping chamber and extending between the moveable wall and the pump housing, and means for selectively controlling communication of the driving chamber with the pressure inlet and the vent.

In one embodiment, the vent is adapted to communicate with the oscillating pressure source, and the means for moving the moveable wall in the opposite direction comprises one-way valve means in the vent for permitting fluid under the pressure different from the operating pressure to communicate with the driving chamber to move the moveable wall in the opposite direction when the driving chamber is in communication with the vent.

In one embodiment, the selective controlling means includes a shuttle valve received in a valve housing.

One of the principal features of this invention is the provision of a fluid driven pump with a large pumping capacity because of the pump's ability to utilize, while fully discharging fluid, the maximum pressure obtained by the oscillating fluid pressure source used to drive the pump.

Another of the principal objects of this invention is the provision of such a pump which can utilize the pressurized fuel-air mixture in a crankcase to drive the pump, while at the same time returning the pressurized fuel-air mixture to the crankcase in order to avoid any loss of fuel.

Another of the principal objects of the inention is to provide such a pump which includes improved shuttle valve means for alternately placing the pump's driving chamber in communication with a fluid inlet and a fluid vent.

Other features and advantages of embodiments of the invention will become apparent upon reviewing the following drawings, the detailed description and the appended claims.

Figure 1:
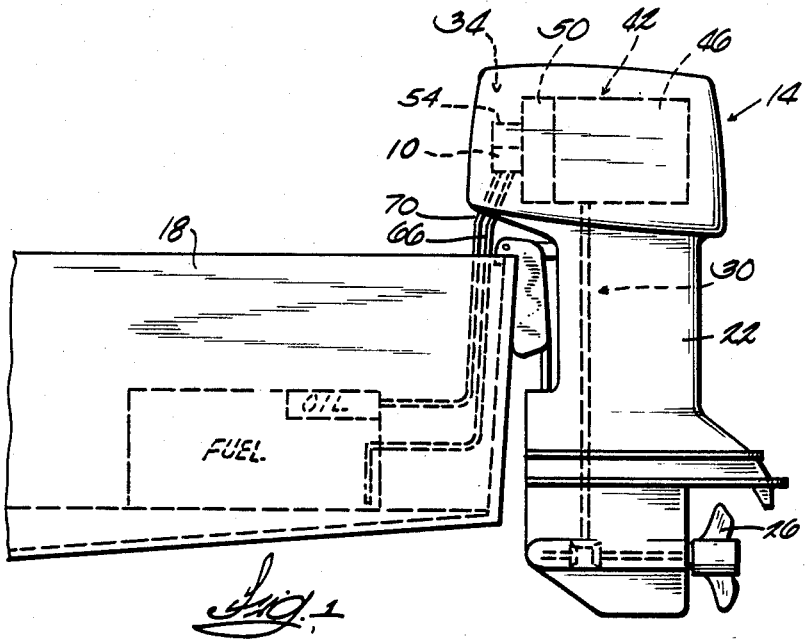
FIG. 1 is a side view of an marine propulsion device mounted on a marine vehicle. The propulsion device includes a fluid driven pump (illustrated schematically) which embodies various of the features of the invention.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF PREFERRED EMBODIMENTS

As illustrated in the drawings, this invention provides a fluid driven pump 10 for pumping fuel. More particularly, as illustrated in FIG. 1, the pump 10 is used in combination with an outboard propulsion device 14 mounted on a marine vehicle 18, but the pump can also be used in other applications to pump other fluids.

The outboard propulsion device 14 includes a lower unit 22 rotatably supporting a propeller 26 and a drive train 30 for rotating the propeller 26. The outboard 14 also includes an upper unit 34 which is attached to the lower unit 22 and which includes a two-stroke engine 42 for driving the drive train 30. The two-stroke internal combustion engine 42 comprises an engine block 46, a crankcase 50 and a carburetor 54 attached by suitable means to the crankcase 50. The pump 10 supplies fuel to the carburetor 54 and is mounted adjacent the carburetor 54 in the upper unit 34. In other embodiments (not shown) the pump 10 can be located remotely from the carburetor 54 and connected to the carburetor 54 by conduits. A source of fuel and a source of oil is located within the marine vehicle 18 and connected by conduits 66 and 70, respectively, to the pump 10, as described in more detail below.

Figure 2:
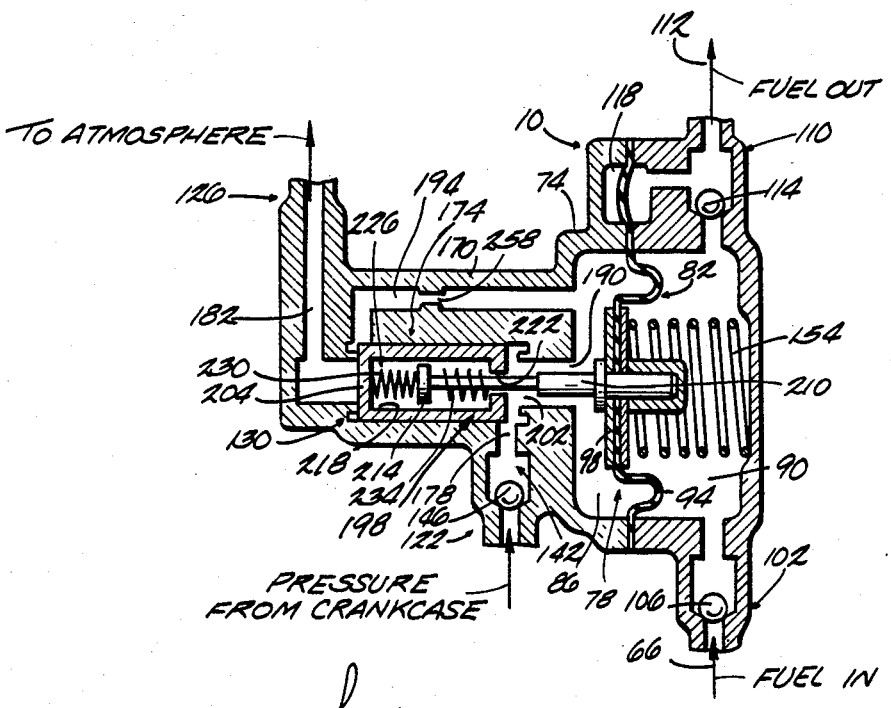
FIG. 2 is a cross-sectional view of a fluid driven pump which embodies various of the features of the invention.
Figure 4:
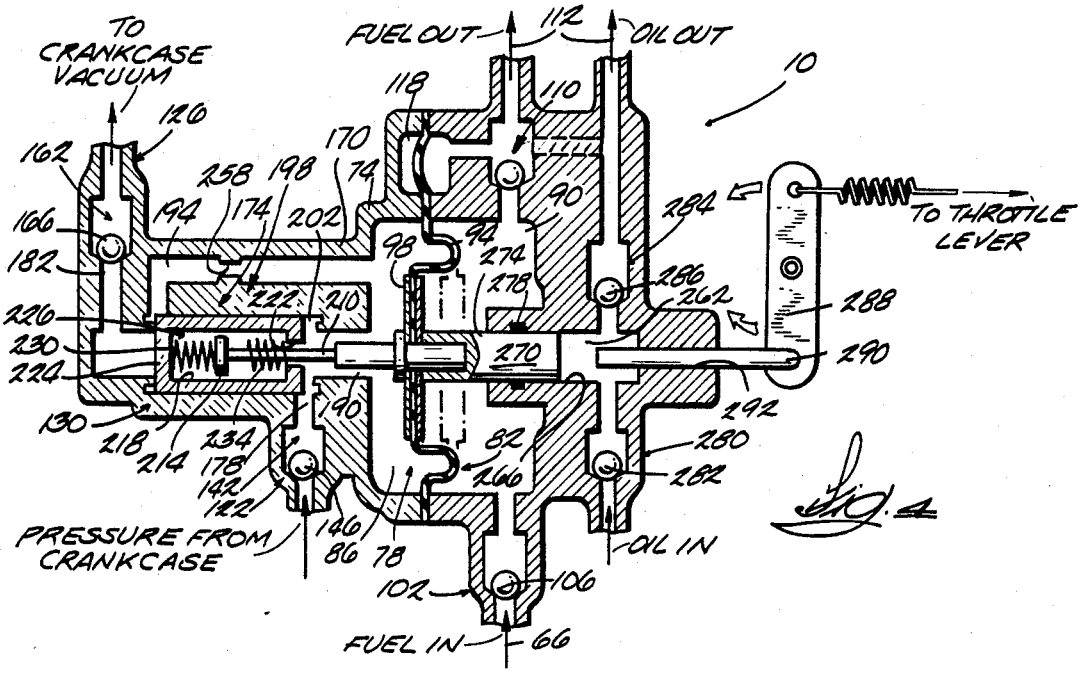
FIG. 4 is a cross-sectional view of still another fluid driven pump which embodies various of the features of the invention.
Figure 3:
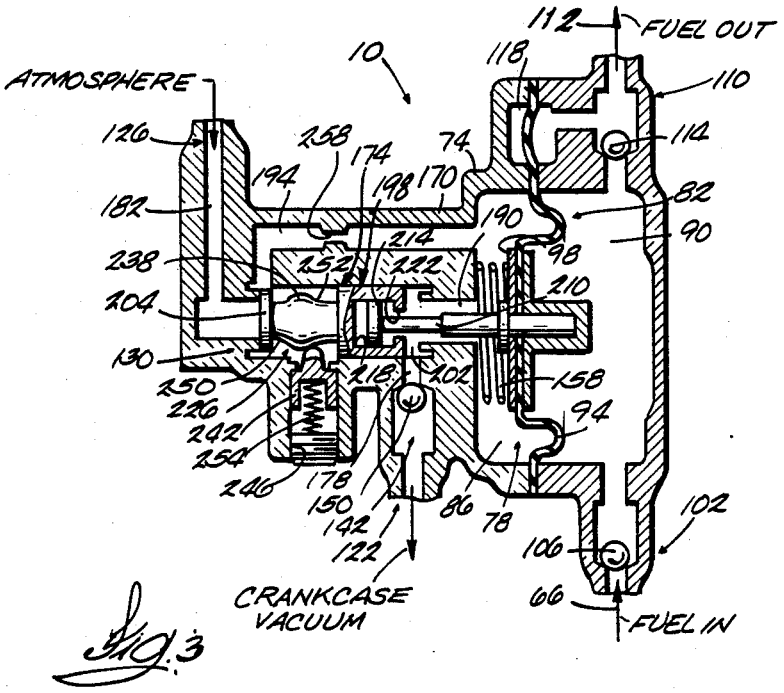
FIG. 3 is a cross-sectional view of another fluid driven pump which embodies various of the features of the invention.

As illustrated in FIGS. 2, 3 and 4, the pump 10 includes a pump housing 74 which defines a recess 78. The pump 10 also includes a moveable wall 82 which is located in the recess 78 and which divides the recess 78 into a variable volume driving chamber 86 and a variable volume pumping chamber 90. The moveable wall 82 comprises a flexible membrane 94 peripherally connected to the pump housing and a pair of plates secured on opposite sides of the flexible membrane 94 to form a piston portion 98 centrally located in the moveable wall.

The pump 10 also includes means for pumping fuel in response to movement of the moveable wall 82. Such means comprises a fuel inlet 102 adapted to be connected by conduit 66 to the fuel tank, a one-way valve 106 in the inlet 102 for introducing fuel into the pumping chamber 90 and for preventing fuel from exiting the pumping chamber 90, a fuel outlet 110 adapted to be connected by conduit 112 to the carburetor 54, and a one-way valve 114 in the outlet 110 for permitting flow of fuel from the pumping chamber 90 and preventing flow of fuel into the pumping chamber 90. The fuel outlet 110 also includes a surge chamber 118 to prevent a surge of fuel from being introduced into the carburetor 54.

The pump 10 further includes means for permitting a source of fluid under pressure to communicate with the driving chamber 86 to move the moveable wall 82 to pump fuel from the variable volume pumping chamber 90. Such means comprises a pressure inlet 122 in the housing 74, a vent 126 in the housing 74, and means 130 for selectively controlling communication of the driving chamber 86 with the pressure inlet 122 and the vent 126.

The pressure inlet 122 is adapted to communicate with a source of fluid subject to a pressure which oscillates between an operating pressure, and a pressure different from the operating pressure. The operating pressure is a pressure different from the pressure at which fuel is introduced into the pumping chamber 90.

In the embodiments illustrated herein, fuel is introduced into the pumping chamber 90 at atmospheric pressure. Accordingly, the operating pressure is a pressure different from atmospheric pressure. This operating pressure can be either above atmospheric pressure or below atmospheric pressure, and the pressure different from the operating pressure, can be either above or below the operating pressure.

In the embodiments illustrated in the drawings, the source of fluid under pressure is the crankcase 50 of the two-stroke engine 42, although other sources can be used in other embodiments. The crankcase 50 of the two-stroke engine 42 contains a fuel-air mixture with a pressure which oscillates between a maximum pressure above atmospheric pressure, and a minimum below atmospheric pressure. These pressure oscillations occur with each complete combustion cycle of the engine's pistons (not shown). The crankcase 50, therefore, provides a suitable source of fluid subject to an oscillating pressure.

The pump 10 further includes one-way value means 142 to use fluid from the oscillating pressure source for moving the moveable wall 82 in one direction when the pressure inlet 122 is in communication with the driving chamber 86, and means for moving the moveable wall 82 in the opposite direction when the driving chamber 86 is in communication with the vent 126.

More particularly, the one-way valve means 142 is included in the pressure inlet 122 and permits only fluid from the crankcase 50 under the chosen operating pressure to be in communication with the driving chamber 86. When the operating pressure is in communication with the driving chamber 86, the pressure differential across the moveable wall 82 causes the volumes of driving chamber 86 and pumping chamber 90 to change, thereby resulting in the entry of fuel into or removal of fuel from the pumping chamber 90, depending on the operating pressure used.

The operating pressure selected can be either the maximum pressure in the crankcase 50, or the minimum pressure in the crankcase 50. Accordingly, the one-way valve means 142 comprises a one-way valve selected to permit either the minimum pressure, which is below the pressure present in the driving chamber 86, or the maximum pressure, which is above the pressure in the driving chamber 86, as hereinafter described, to be in communication with the driving chamber 86.

The embodiments of the pump 10 illustrated in FIGS. 2 and 4 have an operating pressure which is the maximum pressure in the engine crankcase 50. Accordingly, the one-way valve 146 only permits fluid to be introduced into the driving chamber 86 and prohibits fluid from exiting the driving chamber 86.

The embodiment of the pump 10 illustrated in FIG. 3 has an operating pressure which is the minimum pressure in the engine crankcase 50. Accordingly, the one-way valve 150 only permits fluid to exit the driving chamber 86 and prohibits fluid from being introduced into the driving chamber 86.

The carburetor 54 demands fuel from the pump 10 less often than the rate at which oscillations of pressure occur in the engine crankcase 50. Accordingly, the pumping chamber 90 will not discharge and the moveable wall 82 will not move until the carburetor 54 permits fuel to flow from the pump 10. Therefore, sufficient time is available, in the case of the one-way valve 146 to permit fluid to enter the driving chamber 86 and build up pressure with each pressure oscillation, until the pressure in the driving chamber 86 is about equal to the maximum pressure in the crankcase 50. Accordingly, the pump 10 uses the maximum pressure, achieved in the crankcase 50, to achieve full displacement of the moveable wall 82 in order to pump a maximum possible amount of fuel given the particular fluid pressure source.

After the driving chamber 86 achieves the operating pressure of the fluid source and the moveable wall 82 is fully displaced in one direction, the vent 126 provides means for venting the driving chamber 86 to eliminate the driving pressure differential across the moveable wall 82, thereby permitting reverse movement of the moveable wall 82. The vent 126 is therefore adapted to communicate with a source of pressure different from the operating pressure so venting will occur.

In the embodiments illustrated in FIGS. 2 and 3, the vent 126 is adapted to communicate with the atmosphere. When the maximum pressure in the crankcase 50 is used as the operating pressure, the positive gauge pressure created in the driving chamber 86 causes the volume of the driving chamber 86 to increase, and the volume of the pumping chamber 90 to decrease. Then, when the pressure in the driving chamber 86 is vented, the pressure differential across the moveable wall 82 is eliminated. The means provided for moving the moveable wall 82 in the opposite direction therefore comprises a spring 154 which is in the pumping chamber 90 between the portion of the pump housing 74 forming part of the pumping chamber 90, and the piston portion 98 of the moveable wall 82, and which is operative to move the moveable wall 82 in the opposite direction, thereby decreasing the volume of the driving chamber 86, and increasing the volume of the fuel pumping chamber 90.

In the embodiment illustrated in FIG. 3, when the minimum or vacuum pressure in the crankcase 50 is used for the operating pressure, the vacuum in the driving chamber 86 causes the volume of the driving chamber 86 to decrease, and the volume of the pumping chamber 90 to increase. After the pressure is vented, the pressure differential across the moveable wall 82 is eliminated. The means provided for moving the moveable wall 82 in the opposite direction therefore comprises a spring 158 which is in the driving chamber 86 between the portion of the pump housing 74 forming part of the driving chamber 86, and the piston portion 98 of the moveable wall 82, and which is operative to move the moveable wall 82 in the opposite direction.

In the embodiment illustrated in FIG. 4, the vent 126 is in communication with the crankcase 50 of the two stroke engine 42. As a result, the pump 10 utilizes the fuel-air mixture in the crankcase 50 to pump fuel, then returns the fuel-air mixture to the crankcase 50 for use by the engine 42. Accordingly, no fuel-air mixture is discharged to atmosphere or wasted by the pump 10.

More particularly, in the embodiment illustrated in FIG. 4, the vent 126 is in communication with a pressure different from the opeating pressure which is the reverse of the difference between the operating pressure less the pressure at which fuel is introduced into the pumping chamber 90. Accordingly, in this embodiment, the means provided for moving the moveable wall 82 in the opposite direction comprises one-way valve means 162 included in the vent 126 for permitting only fluid with the pressure different from the operating pressure to be in communication with the driving chamber 86, in order to cause venting of the driving chamber and to reverse the pressure differential across the moveable wall 82.

When the operating pressure is above the pressure different from the operating pressure, as in the embodiment illustrated in FIG. 4, the one-way valve means 162 comprises a one-way valve 166 which only permits fluid to exit the vent 126, and prohibits fluid from entering the vent 126. The one-way valve 166 therefore allows a vacuum to build in the driving chamber 86, thereby causing a pressure differential across the moveable wall 82 to decrease the volume of the driving chamber 86 and to increase the volume of the pumping chamber 90.

As illustrated in FIGS. 2, 3 and 4, the selective controlling means 130 comprises a valve housing 170 which, in the embodiments, is integral with the pump housing 74, and which defines a valve chamber 174, a first pressure passageway 178 which extends between the pressure inlet 122 and the valve chamber 174, and a first vent passageway 182 which extends from the valve chamber 174 to the vent 126. The selective controlling means 130 also includes a second pressure passageway 190 which extends from the valve chamber 174 to the driving chamber 86, a second vent passageway 194 which extends from the driving chamber 86 to the valve chamber 174, and a shuttle valve 198 which is received in the valve chamber 174.

The valve chamber 174 includes a first end 202 and a second end 204, and the first and second pressure passageways 178 and 190, respectively, are in communication with the first end 202 of the valve chamber 174, and the first and second vent passageways 183 and 184, respectively, are in communication with the second end 204 of the valve chamber 174.

The shuttle valve 198 is moveable between a first position, wherein the pressure inlet 122 is in communication with the driving chamber 86, and a second position, wherein the vent 126 is in communication with the driving chamber 86. In the first position, the first end 202 of the valve chamber is open and the second end 204 of the valve chamber is sealed by the shuttle valve 198. As a result, in the first position, the first pressure passageway 178 is in communication with the second pressure passageway 190, and the first vent passageway 182 is not in communication with the second vent passageway 194.

In the second position, the second end 204 of the valve chamber 174 is open and the first end 202 of the valve chamber 174 is sealed by the shuttle valve 198. As a result, in this second position, the first vent passageway 182 is in communication with the second vent passageway 194, and the first pressure passageway 178 is not in communication with the second pressure passageway 194.

The selective controlling means 130 also includes means for connecting the shuttle valve 198 to the moveable wall 82 and for permitting lost motion between the shuttle valve 198 and the moveable wall 82. This lost motion means insures the shuttle valve 198 does not move from the first position to the second position until the moveable wall 82 is fully displaced in one direction. Likewise, the lost motion means insures the shuttle valve 198 moves back in the other direction, from the second position to the first position, only when the moveable wall 82 is fully displaced in the opposite direction.

The lost motion means comprises a rod 210 with an end which is attached, by suitable means, to the piston portion 98 of the moveable wall 82, and which extends through the second pressure passageway 190 to the shuttle valve 198. In other embodiments (not shown), a separate bore could be provided for the second pressure passageway, and the passageway between the shuttle valve 198 and the piston 98 can receive the rod 210 and include a seal to prevent the passage of fluid around the rod 210.

The other end 214 of the rod 210 is slidably received and secured in a recess 218 in the shuttle valve 198. More particularly, the rod 210 extends through an opening 222 into the recess 218 in the shuttle valve 198, and the end 214 of the rod 210 is received in the recess 218 and is larger than the opening 222 through which the rod 210 extends.

In order to prevent the shuttle valve 198 from being located centrally between the first and second positions, the selective controlling means 130 also includes detent means 226 for alternately biasing the shuttle valve 198 towards the first position and the second position. As illustrated in FIGS. 2 and 4, one embodiment of the detent means 226 comprises springs 230 and 234 in the shuttle valve 198. One spring 230 extends between the end 214 of the rod 210 and one end of the shuttle valve 198, while the other spring 234 is concentric with the rod 210 and disposed between the end 214 of the rod 210 and the other end of the shuttle valve 198.

When the shuttle valve 198 is in either the first or second position, one of the springs 230 and 234 is compressed, while the other spring is relaxed. As the end 214 of the rod 210 starts to move from one end of the recess 218 to the other, the compressed spring begins to relax and the other spring eventually begins to compress forcing the shuttle valve 198 to the other position. Some movement of the end 214 of the rod 210 is required before the compressed spring becomes fully relaxed, so the shuttle valve 198 is urged to remain in its current position by the still compressed spring despite the initial movement of the end 214 of the rod 210.

As illustrated in FIG. 3, another embodiment of such detent means 226 comprises a raised portion 238 incorporated into the side of the shuttle valve 198 between the ends thereof, and a rounded member 242 adjacent the raised portion 238 and received in a bore 246 in the side of the valve housing 170.

The raised portion 238 of the shuttle valve 198 includes two inclined surfaces 250 and 252, which come together to form a peak on the side of the shuttle valve 198. Means in the form of spring 254 located in the bore 246 is provided for biasing the rounded member 242 towards the raised portion 238 of the shuttle valve 198, so the rounded member 242 acts on the inclined surfaces 250 and 252 of the raised portion 238 urging the shuttle valve 198 in either one direction or the other, depending on which side of the raised portion 238 the rounded member 242 is on. In this manner, the shuttle valve 198 is urged to remain in either the first or second position until moved by the rod 210 attached to the moveable wall 82.

A restriction 258 is also provided in the second vent passageway 194 (or in the second pressure passageway 190 in other embodiments) to assist in biasing the shuttle valve 198 towards the first or second position. When operation of the pump 10 is initiated, the restriction 258 slows the access of the vent fluid to the driving chamber 86, thereby insuring the vent end of the shuttle valve 198 is subject to the vent pressure, while the pressure end of the shuttle valve 198 is subject to inlet pressure. The pressure difference across the shuttle valve 198 then urges the shuttle valve 198 towards one of the first and second positions.

The springs 154 and 158 also assist in biasing the shuttle valve 198 towards one of the first and second positions.

As illustrated in FIG. 4, the fluid driven pump 10 can also include means for pumping oil, or some other fluid, in addition to means for pumping fuel. The oil pumping means comprises a variable volume oil pumping chamber 262 formed by a closed bore 266 extending from the pumping chamber 90 and perpendicularly from the moveable wall 82, and the end 270 of a plunger 274 received in the bore 266. The other end of the plunger 274 is attached by suitable means to the piston portion 98 of the moveable wall 82. The volume of the oil pumping chamber 90 therefore varies with the movement of the moveable wall 82.

In this embodiment, the oil pumping 262 chamber is approximately one-fiftieth the size of the fuel pumping chamber 90, in order to provide for a proper oil to fuel ratio. A seal 278 is also provided around the plunger 274 to prevent the oil chamber 262 from communicating with the fuel pumping chamber 90.

The oil pumping means also includes an inlet 280 including a one-way valve 282 for introducing oil into the oil chamber 262 and for preventing oil from exiting the oil chamber 262, and an outlet 284 including a one-way valve 286 for permitting oil flow from the oil chamber 262 and for preventing oil flow into the oil chamber 262.

The oil chamber inlet 280 is connected by conduit 70 to the source of oil, and the outlet 284 from the oil pumping chamber 262 is in communication with the fuel line 112 to the carburetor 54, or, in an alternate embodiment, the outlet 284 can be in direct communication with the fuel outlet 110, as illustrated by the dashed lines in FIG. 4.

The pump 10 also includes means for varying the volume of the oil pumping chamber 262 as the speed of the engine varies, in order to vary the pump's oil-fuel ratio as a function of engine speed. Such varying means comprises a lever 288 which is pivotally mounted adjacent the pump housing 74 and which is pivotally connected at one end to a throttle lever (not shown) provided for the carburetor 54, and a bar 290 pivotally attached to the other end of the lever 288. The bar 290 extends through a bore 292 in the pump housing 74 into the variable volume oil pumping chamber 262. The bar 290 is inserted by the lever 288 into the oil pumping chamber 262 until the bar 290 contacts the piston 270 before the pumping stroke, when less oil per unit of fuel is desired at lower engine speeds, and removed when more oil per unit of fuel is desired at higher engine speeds.

In other embodiments (not shown), the pump 10 can include priming means for introducing fuel and oil into the pump when operation of the pump 10 is initiated.

Various of the features of the invention are set forth in the following claims.

I claim:

1. A fluid driven pump comprising a pump housing defining a recess including therein a moveable wall which divides said recess into a variable volume driving chamber and a variable volume pumping chamber, a pressure inlet communicable with said driving chamber and adapted to communicate with a source of pressure which oscillates between an operating pressure and a pressure different from the operating pressure, said pressure inlet including one-way valve means for permitting fluid under the operating pressure to communicate with said driving chamber and thereby to move said moveable wall in one direction when said driving chamber is in communication with said pressure inlet, a vent communicable with said driving chamber and adapted to be in communication with a source of pressure different from said operating pressure, a spring in said pumping chamber and extending between said moveable wall and said pump housing, and means for selectively controlling communication of said driving chamber with said pressure inlet and said vent.

2. A fluid driven pump in accordance with claim 1, wherein said pump housing further includes a bore which extends perpendicularly from said moveable wall and which partially defines a second variable volume pumping chamber, and wherein said pump further includes a piston which is received in said bore and which includes a first end and a second end, said first end being attached to said moveable wall and said second end cooperating with said bore to form said variable volume pumping chamber, and means for alternately permitting fluid flow into and fluid flow from said second pumping chamber.

3. A fluid driven pump in accordance with claim 2 wherein said means for alternately permitting fluid flow into and fluid flow from said second pumping chamber comprises one-way valve means for permitting fluid flow into said second pumping chamber, and one-way valve means for permitting fluid flow from said second pumping chamber.

4. A fluid driven pump in accordance with claim 2 and further including means for varying the output of said second pumping chamber in direct proportion to the rate of pressure oscillation of said fluid source.

5. A fluid driven pump comprising a pump housing defining a recess including therein a moveable wall which divides said recess into a variable volume driving chamber and a variable volume pumping chamber, a pressure inlet communicable with said driving chamber and adapted to communicate with a source of pressure which oscillates between a positive operating pressure and a pressure less than the operating pressure, said pressure inlet including a one-way valve permitting fluid flow into said driving chamber and prohibiting fluid flow from said driving chamber, and thereby to move said moveable wall in one direction when said driving chamber is in communication with said pressure inlet, a vent communicable with said driving chamber and adapted to be in communication with a source of pressure different from said operating pressure, means for moving said moveable wall in the opposite direction when said driving chamber is in communication with said vent, and means for selectively controlling communication of said driving chamber with said pressure inlet and said vent.

6. A fluid driven pump in accordance with claim 5 wherein said means for moving said moveable wall in the opposite direction comprises a spring in said pumping chamber and extending between said moveable wall and said pump housing.

7. A fluid driven pump in accordance with claim 5, wherein said pump housing further includes a bore which extends perpendicularly from said moveable wall and which partially defines a second variable volume pumping chamber, and wherein said pump further includes a piston which is received in said bore and which includes a first end and a second end, said first end being attached to said moveable wall and said second end cooperating with said bore to form said variable volume pumping chamber, and means for alternately permitting fluid flow into and fluid flow from said second pumping chamber.

8. A fluid driven pump in accordance with claim 7 wherein said means for alternately permitting fluid flow into and fluid flow from said second pumping chamber comprises one-way valve means for permitting fluid flow into said second pumping chamber, and one-way valve means for permitting fluid flow from said second pumping chamber.

9. A fluid driven pump in accordance with claim 7 and further including means for varying the output of said second pumping chamber in direct proportion to the rate of pressure oscillation of said fluid source.

10. A fluid driven pump comprising a pump housing defining a recess including therein a moveable wall which divides said recess into a variable volume driving chamber and a variable volume pumping chamber, a pressure inlet communicable with said driving chamber and adapted to communicate with a source of pressure which oscillates between an operating pressure and a pressure different from the operating pressure, said pressure inlet including one-way valve means for permitting fluid under the operating pressure to communicate with said driving chamber and thereby to move said moveable wall in one direction when said driving chamber is in communication with said pressure inlet, a vent communicable with said driving chamber and adapted to be in communication with a source of pressure different from said operating pressure, means for moving said moveable wall in the opposite direction when said driving chamber is in communication with said vent, and means for selectively controlling communication of said driving chamber with said pressure inlet and said vent, said selective controlling means comprising a valve housing defining a valve chamber including a first end and a second end, a first pressure passageway extending between said pressure inlet and said valve chamber, a second pressure passageway extending from said valve chamber to said driving chamber, one of said pressure passageways communicating with said first end of said valve chamber, a first vent passageway extending from said valve chamber to said vent, a second vent passageway extending from said driving chamber to said valve chamber, one of said vent passageways communicating with said second end of said valve chamber, a shuttle valve in said valve chamber and moveable between a first position adjacent said first end wherein said first pressure passageway is in communication with said second pressure passageway and said first vent passageway is not in communication with said second vent passageway, and a second position adjacent said second end wherein said first vent passageway is in communication with said second vent passageway and said first pressure passageway is not in communication with said second pressure passageway, and means connecting said shuttle valve to said moveable wall and providing for lost motion between said shuttle valve and said moveable wall.

11. A fluid driven pump in accordance with claim 10 wherein said selective controlling means further includes detent means for alternately biasing said shuttle valve towards said first position and said second position.

12. A fluid driven pump in accordance with claim 10 wherein said pump housing further includes one-way valve means for permitting fluid flow into said variable volume pumping chamber, and one-way valve means for permitting fluid flow out of said variable volume pumping chamber.

13. A fluid driven pump in accordance with claim 10 wherein said vent is adapted to communicate with the oscillating pressure source and wherein said means for moving said moveable wall in the opposite direction comprises one-way valve means included in said vent for permitting fluid under the pressure different from the operating pressure to communicate with said driving chamber to move said moveable wall in the opposite direction when said driving chamber is in communication with said vent.

14. A fluid driven pump in accordance with claim 10 wherein said selective controlling means further includes detent means for alternately biasing said shuttle valve towards the first position and the second position.

15. A fluid driven pump in accordance with claim 10 wherein the operating pressure is greater than the pressure different from the operating pressure, and wherein said one-way valve means comprises a one-way valve permitting fluid flow into said driving chamber and prohibiting fluid flow from said driving chamber.

16. A fluid driven pump in accordance with claim 15 wherein said means for moving said moveable wall in the opposite direction comprises a spring in said pumping chamber and extending between said moveable wall and said pump housing.

17. A fluid driven pump in accordance with claim 10 wherein the operating pressure is less than the pressure different from the operating pressure, and wherein said one-way valve means comprises a one-way valve permitting fluid flow from said driving chamber and prohibiting fluid flow from said driving chamber.

18. A fluid driven pump in accordance with claim 8 wherein said means for moving said moveable wall in the opposite direction comprises a spring in said driving chamber and extending between said moveable wall and said pump housing.

19. A fluid driven pump in accordance with claim 10, wherein said pump housing further includes a bore which extends perpendicularly from said moveable wall and which partially defines a second variable volume pumping chamber, and wherein said pump further includes a piston which is received in said bore and which includes a first end and a second end, said first end being attached to said moveable wall and said second end cooperating with said bore to form said variable volume pumping chamber, and means for alternately permitting fluid flow into and fluid flow from said second pumping chamber.

20. A fluid driven pump in accordance with claim 19 wherein said means for alternately permitting fluid flow into and fluid flow from said second pumping chamber comprises one-way valve means for permitting fluid flow into said second pumping chamber, and one-way valve means for permitting fluid flow from said second pumping chamber.

21. A fluid driven pump in accordance with claim 19 and further including means for varying the output of said second pumping chamber in direct proportion to the rate of pressure oscillation of said fluid source.

* * * * *